US009487940B2

(12) United States Patent
Shair

(10) Patent No.: US 9,487,940 B2
(45) Date of Patent: Nov. 8, 2016

(54) BIO-WASTE DISPOSAL SYSTEM

(71) Applicant: Alex Shair, Lake Zurich, IL (US)

(72) Inventor: Alex Shair, Lake Zurich, IL (US)

( * ) Notice: Subject to any disclaimer, the term of this patent is extended or adjusted under 35 U.S.C. 154(b) by 251 days.

(21) Appl. No.: 14/476,773

(22) Filed: Sep. 4, 2014

(65) Prior Publication Data

US 2016/0069058 A1 Mar. 10, 2016

Related U.S. Application Data

(60) Provisional application No. 61/873,850, filed on Sep. 5, 2013.

(51) Int. Cl.
*E03D 9/10* (2006.01)
*E03D 11/11* (2006.01)

(52) U.S. Cl.
CPC *E03D 9/10* (2013.01); *E03D 11/11* (2013.01)

(58) Field of Classification Search
CPC ..... E03D 9/10; E03D 11/11
USPC ..... 4/319, 320
See application file for complete search history.

(56) References Cited

U.S. PATENT DOCUMENTS 1,509,891 A * 9/1924 Wildman ..... A47K 11/035 4/320
3,858,813 A * 1/1975 Hiller ..... E03D 9/10 241/246
4,347,142 A * 8/1982 Albertassi ..... C02F 1/76 210/173
5,400,443 A * 3/1995 Marino ..... E03D 11/11 4/111.5
5,598,641 A * 2/1997 Kishi ..... E03D 5/00 110/238
6,442,768 B1 * 9/2002 Hammond ..... A47K 11/023 4/111.1
2006/0130439 A1 * 6/2006 Stravitz ..... B65B 9/15 53/567
2015/0322657 A1 * 11/2015 Ballestra ..... B63B 29/14 4/319

* cited by examiner

*Primary Examiner* — J. Casimer Jacyna
(74) *Attorney, Agent, or Firm* — Justin Lampel

(57) ABSTRACT

A bio-waste disposal system is provided. The bio-waste disposal system is incorporated into a standard toilet. The device utilizes a ring gear and pinion concept. A plurality of flaps secured to the interior surface of the ring gear rotates and breaks down solid waste placed within a toilet. The pinion shaft is secured to a motor which may be AC or DC powered. An LED light may indicate if the device is on or off, functional or non-function or other important information.

17 Claims, 7 Drawing Sheets

BIO-WASTE DISPOSAL SYSTEM

CROSS REFERENCE TO RELATED APPLICATIONS

The following application is based on and claims the priority benefit of U.S. provisional application Ser. No. 61/873,850 filed Sep. 5, 2013; the entire contents of which are incorporated by reference.

BACKGROUND OF THE INVENTION

A bio-waste disposal system is provided. The bio-waste disposal system is incorporated into a standard toilet. The device utilizes a ring gear and pinion concept. A plurality of flaps secured to the interior surface of the ring gear rotates and breaks down solid waste placed within a toilet. The pinion shaft is secured to a motor which may be AC or DC powered. An LED light may indicate if the device is on or off, functional or non-function or other important information.

Over the years, attempts have been made to provide a toilet which eliminates clogging of human waste. For example, U.S. Pat. No. 4,052,758 to Arena discloses a human waste disposal system having an improved toilet, a transfer system and an intermediate sealing means. The toilet includes a bowl with flushing nozzles that use a minimum amount of fluid or a mixture of fluid as a flushing agent. The bowl has a liquid disposing portion separated from a solid disposing portion. The intermediate sealing means may include a valve means operated by a hydraulic, mechanical or electrical means. The solid transfer means includes a liquid system and a separate solid transfer system. The solid transfer system includes a grinding, material moving mechanism located at the lowermost area of the solid disposing portion of the bowl. The mechanism is positioned on the vertical centerline of the solid disposing portion of the bowl. The mechanism grinds the solid materials and forces or pumps the ground solid material into a solid transfer conduit to store solids in a distant, generally sealed, collecting tank that is open to atmosphere. The material in the collecting tanks may be used as raw materials for fertilizer production purposes.

Further, U.S. Pat. No. 6,101,638 to Hammond discloses a self-contained toilet that does not require water for operation and does not require chemicals for operation including a toilet bowl enclosure that is cleaned by compressed air pressure and provides for human waste to be forced down into a heat and grinding chamber that becomes closed off by a sliding door. The air pressure comes from an internal compressor and air tank which not only cleans the toilet bowl but is also used for forcing ventilation of odor and humidity while the evaporation and dehydration process is taking place and is further used to blow the dehydrated powder waste into a bag or holding area. The dehydration process can operate from one person while the toilet is being used by another; further the dehydration process can be interrupted repeatedly with other deposits of human waste and then resume operation until fully dehydrated. A humidity sensor is used to identify completion of the dehydration process which opens the valve to the powdered waste bag or containment area.

U.S. Pat. No. 5,564,133 to Kishi discloses a raw sewage disposal apparatus capable of easily stirring raw sewage and cleaning a container by rotating the container per se after introducing the raw sewage into the container and heating, evaporating and drying the raw sewage. The raw sewage disposal apparatus comprises a container for accommodating raw sewage therein, an electromagnetic heater for heating the container, a rotary holder for rotatably holding the container, a driver for rotating the container, spherical stirrers accommodated in the container, and a nonrotatable baffle having one end fixed to the cover plate and the other end extending to a position adjacent to the bottom of the container so as to contact the stirrers.

However, these patents fail to describe a bio-waste disposal system which is easy to use and efficient as is described in the present application. Further, these patents fail to provide a bio-waste disposal system which maybe retro-fitted in a standard toilet.

SUMMARY OF THE INVENTION

A bio-waste disposal system is provided. The bio-waste disposal system is incorporated into a standard toilet. The device utilizes a ring gear and pinion concept. A plurality of flaps secured to the interior surface of the ring gear rotates and breaks down solid waste placed within a toilet. The pinion shaft is secured to a motor which may be AC or DC powered. An LED light may indicate if the device is on or off, functional or non-function or other important information.

An advantage of the present bio-waste disposal system is that the present bio-waste disposal system may be powered by AC outlet power or Battery.

Yet another advantage of the present bio-waste disposal system is that the present bio-waste disposal system may require less water than a standard toilet.

Still another advantage of the present bio-waste disposal system is that the present bio-waste disposal system may eliminate clogging associated with standard toilets by physically breaking down bio-waste and other articles placed in the toilet.

And another advantage of the present bio-waste disposal system is that the present bio-waste disposal system may have an LED indicator to indicate a low battery power level, on or off status, malfunctions or other important information. The LED indicator may be located on an external mounted power pack so as to not cause potential safety problems if the electrical circuitry is exposed to water.

Yet another advantage of the present bio-waste disposal system is that the present bio-waste disposal system may be configurable so as to automatically activate at certain predetermined times and/or upon being triggered by a sensor or manual flushing.

Still another advantage of the present device is that a user may simply turn off the device and use the toilet as a regular toilet.

Still another advantage of the present bio-waste disposal system is that the present bio-waste disposal system has improved sanitation.

And yet another advantage of the present bio-waste disposal system is that the present bio-waste disposal system may utilize a suction force, for example, through suction cups, to secure the system within a toilet.

Yet another advantage of the present bio-waste disposal system is the present device may be removed or replaced from a toilet without damaging or scuffing the toilet.

Still another advantage of the present bio-waste disposal system is the toilet may be regularly brushed and chemically cleaned with no impact to the device or toilet.

Yet another advantage of the present bio-waste system is that the present device may accommodate for different toilet inlet shapes and sizes as the device may have various sized diameter openings.

Yet another advantage of the present bio-waste system is that the present bio-waste disposal system may have flaps secured to the generally circular track (referred to as a ring gear) wherein the flaps may pivot along a pivot point in the direction of water flow so as to allow the user to use the toilet without activating the device and further to reduce the chances of anything becoming stuck in the device.

Still another advantage of the present bio-waste system is that the present bio-waste disposal system may have dull flaps so as to reduce the chances of waste or paper catching on the rotating flaps.

For a more complete understanding of the above listed features and advantages of the present bio-waste disposal system, reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A bio-waste disposal system is provided. The bio-waste disposal system is incorporated into a standard toilet. The device utilizes a ring gear and pinion concept. A plurality of flaps secured to the interior surface of the ring gear rotates and breaks down solid waste placed within a toilet. The pinion shaft is secured to a motor which may be AC or DC powered. An LED light may indicate if the device is on or off, functional or non-function or other important information.

Figure 1:
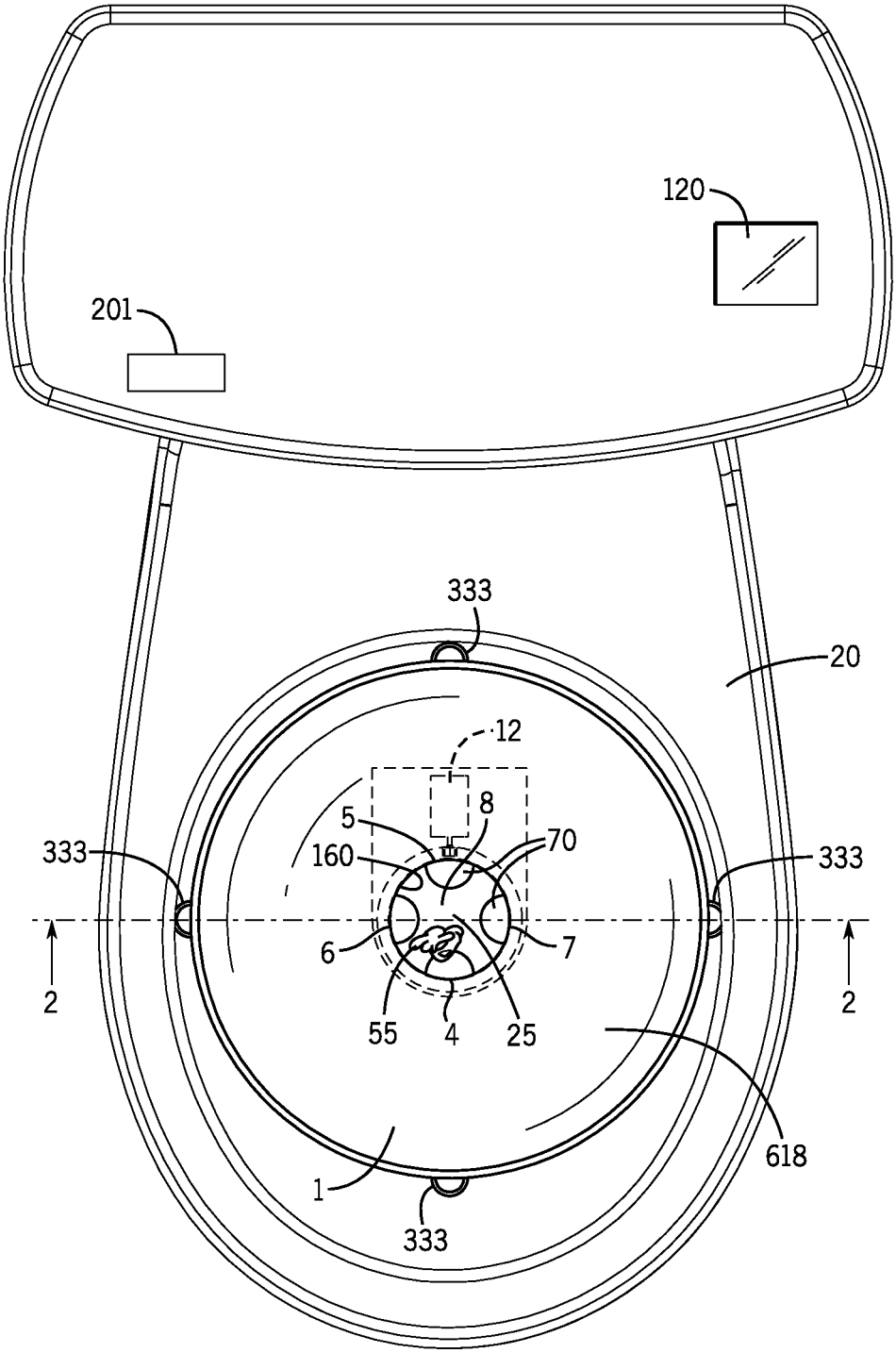
FIG. 1 illustrates a top plan view of a toilet having the bio-waste disposal unit.

Referring now to FIG. 1, a bio-waste disposal system 1 is provided. The device 1 is especially suitable to be used in connection with a toilet 20. The bio-waste disposal system 1 may have a top 2 (FIG. 2), a bottom 3, a front 4, a back 5, a first side 6, a second side 7 and an interior 8. Preferably, the device 1 is largely made of durable material compatible with bio waste systems so as to withstand prolonged exposure to water and cleaning chemicals.

Figure 4B:
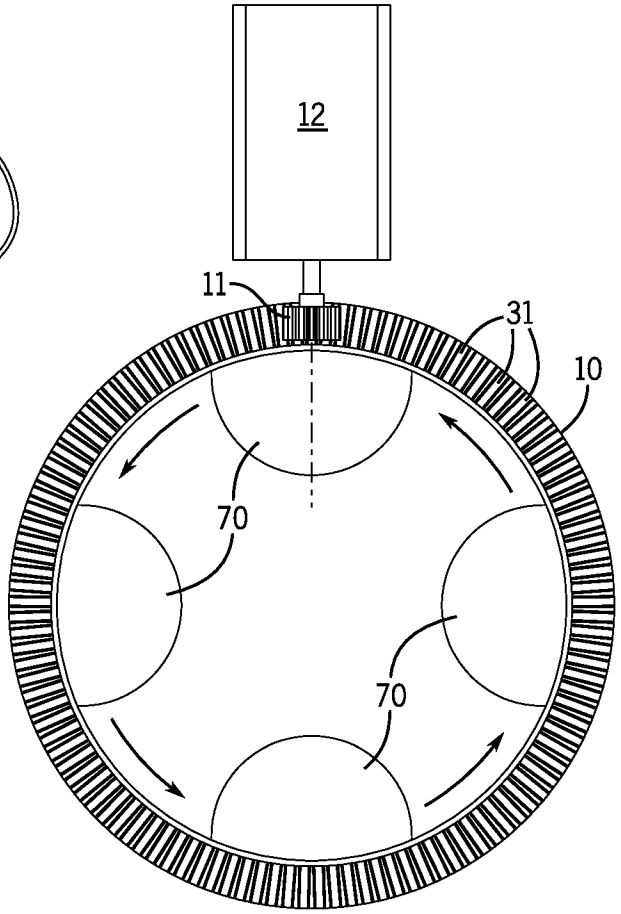
FIG. 4B is a top view of the ring gear of the device.
Figure 4A:
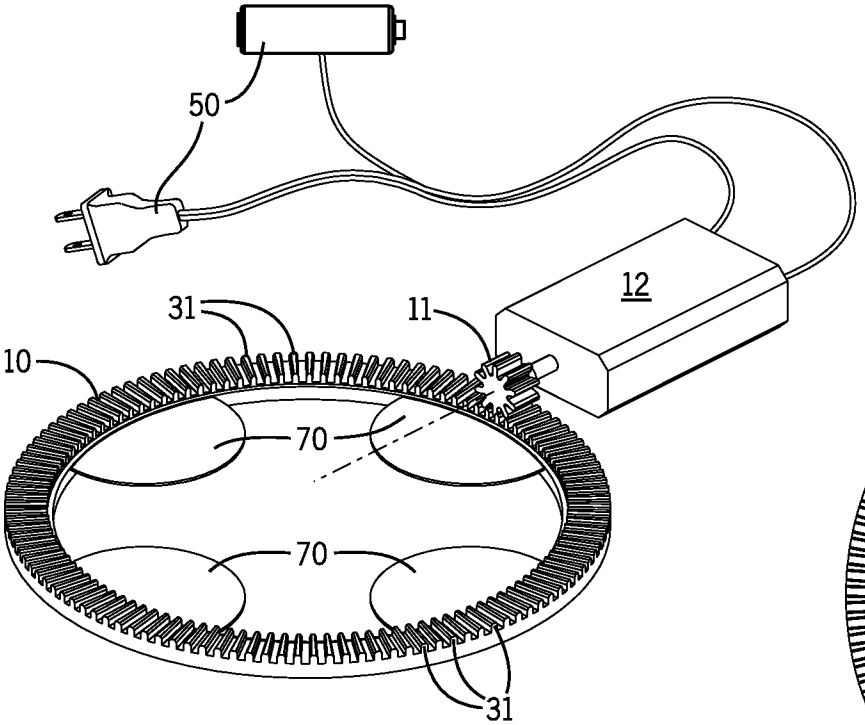
FIG. 4A illustrates a perspective view of the ring gears of the device.

The bio-waste disposal system 1 may have a ring gear 10 (FIG. 4A), a pinion 11 and a motor 12. The bio-waste disposal system 1 may be prebuilt into a toilet 20 or may be retrofitted into an existing toilet 20 by securing the device 1 to the interior of a toilet 20 by means of, for example, a plurality of suction cups 300 (as described below and illustrated in FIG. 2) which may be temporarily secured to the interior of a toilet 20. In particular, the ring gear 10 of the bio-waste disposal system 1 may be located along the bottom opening (outlet) 25 of the toilet 20 (just above the outlet of the toilet 20; wherein the bottom opening 25 extends to pipes which exit the building. Although a liquid tight seal is not required, in an embodiment, the ring gear 10 may surround the opening 25 of the bottom of the toilet 20 such that a liquid tight seal is created between the ring gear 10 and the opening 25 of the bottom of the toilet 20 so that any waste 55 or liquid which passes through the opening 25 of the toilet 20 must first pass through the ring gear 10 of the device 1. In particular, in an embodiment, a rubber, metal or plastic gasket (160) may be located between the ring gear 10 and the bottom of the toilet 20 so as to create the liquid tight seal.

Figure 2:
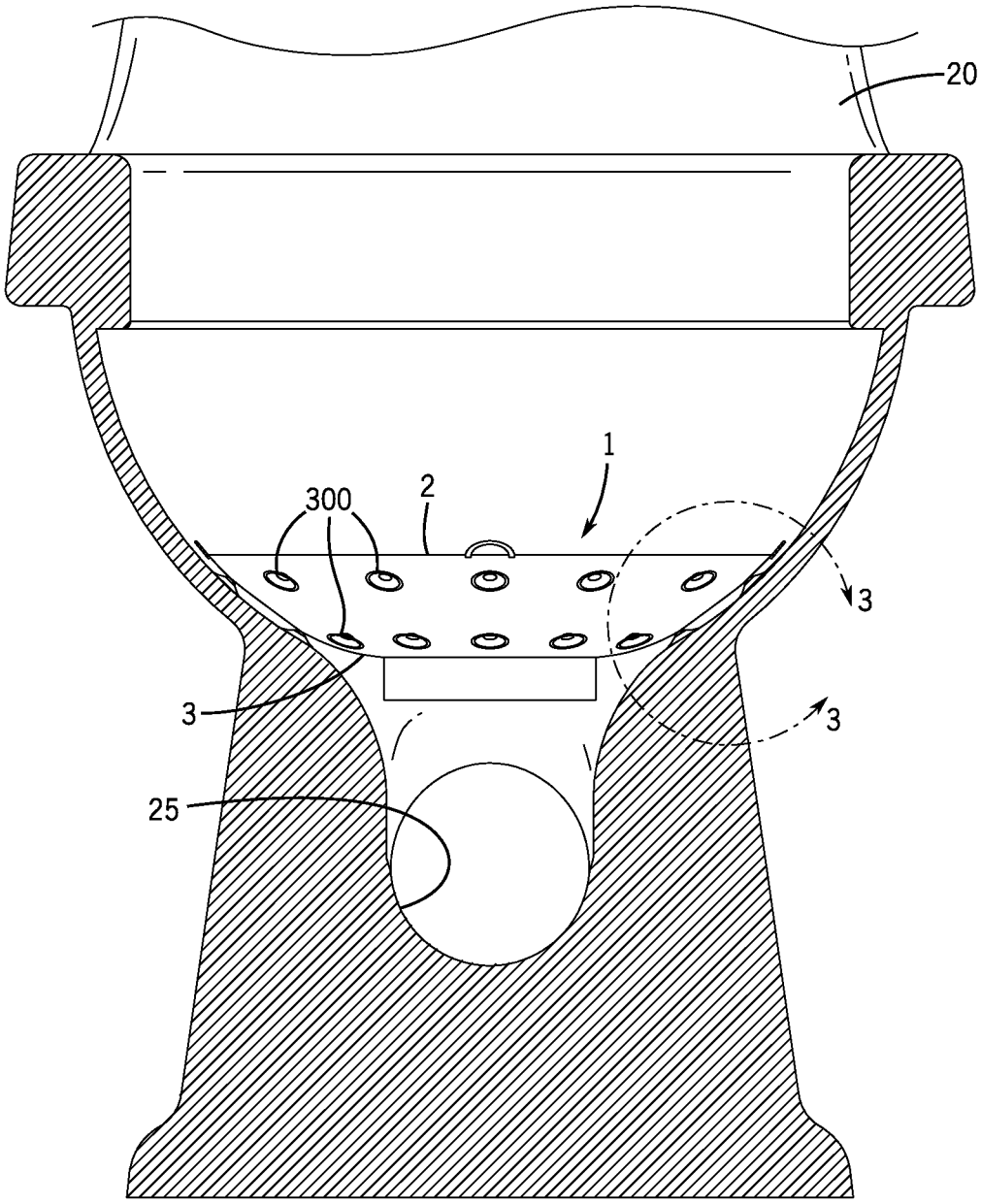
FIG. 2 illustrates a side plan view of the device secured in a toilet.
Figure 3:
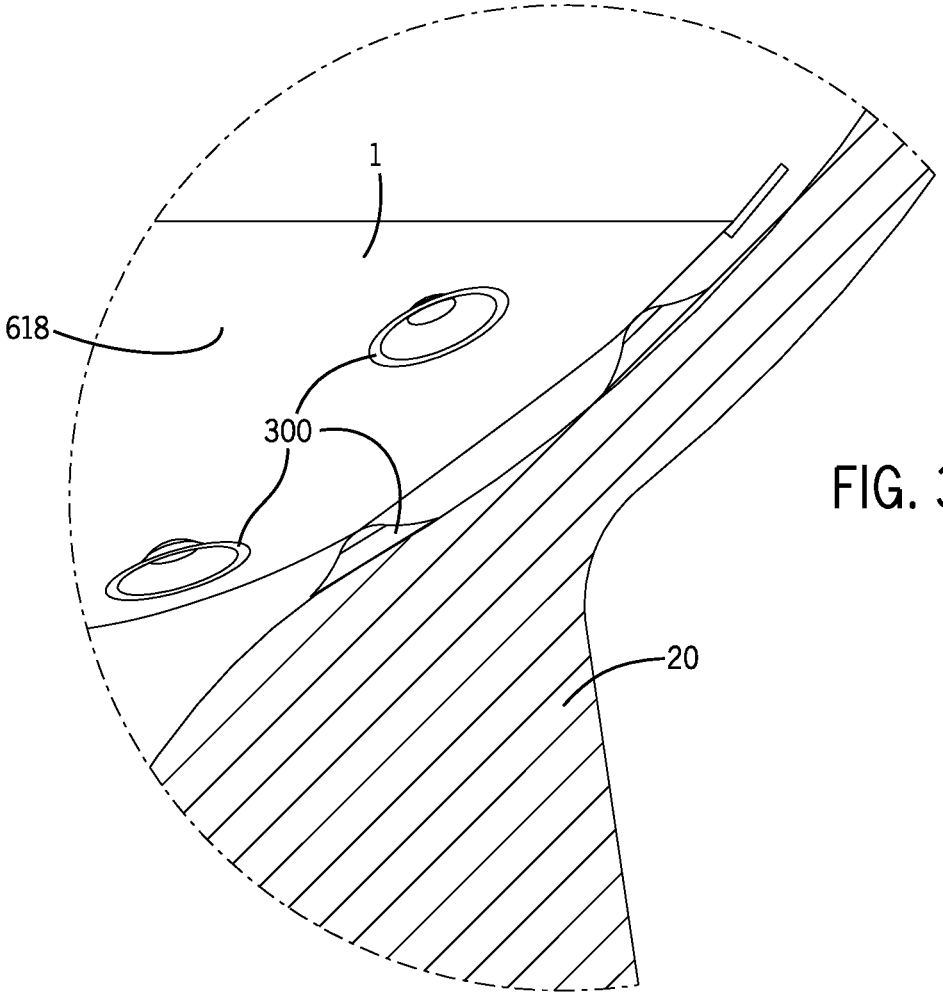
FIG. 3 illustrates a bottom view of the suction cups of the device.

Referring to FIGS. 1 and 2, in an embodiment, the device 1 may have a generally circular, cone-shaped funnel 618 which surrounds the gear ring 10. The generally circular, cone-shaped funnel 618 may guide waste 55 toward the opening in the gear ring 10. In an embodiment, the bottom of the generally circular, cone-shaped funnel 618 may be similar in shape as the bottom interior bowl portion of a toilet 20 so as to allow the device 1 to more easily fit within a toilet 20. Preferably, the generally circular, cone-shaped funnel 618 is slightly flexible so as to allow the device 1 to adopt a similar shape as the shape of the interior bowl of the toilet 20.

The generally circular, cone-shaped funnel 618 may have a plurality of loops 333. The plurality of loops 333 may be used to place the device 1 in or to remove the device 1 from the toilet 20. In particular, a person may grasp one or more loops 333 to align the device 1 properly within the toilet 20 or to remove the device 1 from the toilet 20 without the need to grasp the device 1 near the flap 70 portion of the device 1 (as described below).

Figure 5B:
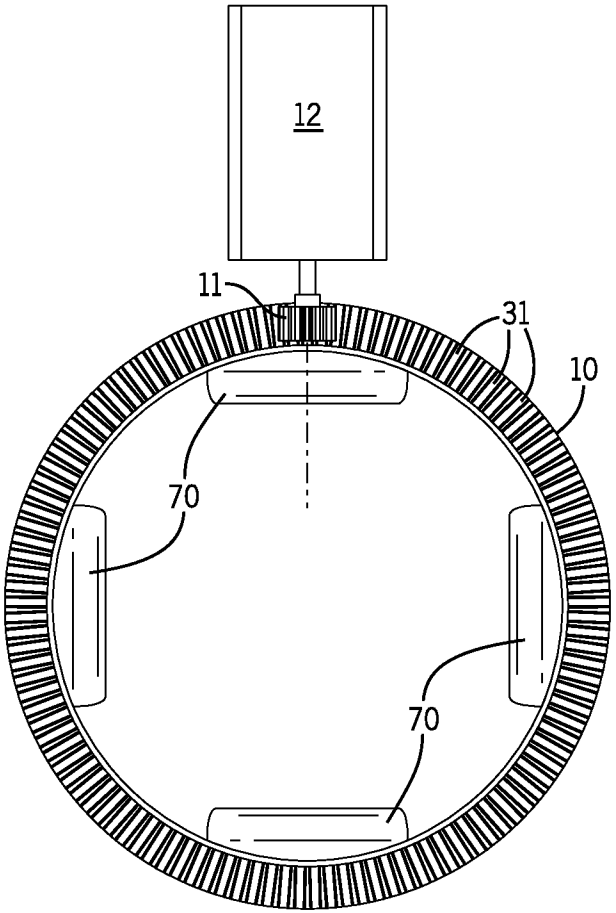
FIG. 5B illustrates a top view of FIG. 5A.
Figure 5A:
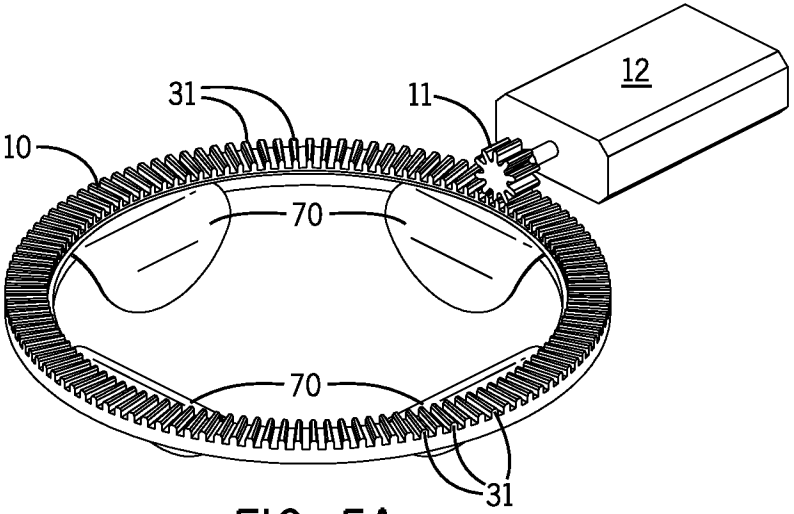
FIG. 5A illustrates an embodiment of the flaps of the device secured to the ring gear wherein the entire back of the flaps are secured to the ring gear and the flaps are in the down orientation.

In an embodiment, the pinion 11 may have teeth (pinion gears) which correspondingly fit with and mate with teeth 31 (FIG. 5A) of the ring gear 10 so that the pinion 11 may rotate along the ring gear 10 and may cause the ring gear 10 to rotate in a clockwise or counter-clockwise manner while the pinion 11 remains in a stationary but rotating orientation. The pinion 11 may rotate along an axis. More specifically, the pinion 11 may rotate as a result of being mechanically connected to and powered by a motor 12 which is electrically connected to a power source 50. The power source may be, for example, AC outlet or battery. In an embodiment, only the interior surface of ring gear 10 and the flaps 70 (as described below) make physical contact with the water/waste 55. The motor, shaft and ring gear are in an insulated enclosure.

In an embodiment, the device 1 may have a plurality of flaps 70 secured to the ring gear 10. More specifically, the plurality of flaps 70 may rotate in unison with the ring gear 10 and may face inward toward the center of the toilet 20. The figures illustrate four flaps 70; however, any number of flaps 70 may be used. For example, the device 1 may have fewer flaps 70 (such as two) wherein each of the flaps 70 is larger than the four flaps 70 version. In an embodiment the flaps 70 may be made from metal, hard plastic, rubber or the like. As the pinion 11 rotates in place therein forcing the ring gear 10 to rotate clockwise or counter-clockwise, any waste 55 (such as human waste, paper products or the like) which is located within the interior of the ring gear 10 may be broken down by rotating flaps 70, cut and reduced in size so as to more easily be flushed down the opening 25 of the toilet 20.

In an embodiment, the toilet 20 may have an LED indicator 120 (FIG. 1). The LED indicator 120 may be activated if, for example, the power source 50 is low (for the battery embodiment). In addition, the LED indicator 120 may be activated if the device 1 is clogged or otherwise non-functional. In an embodiment, the device 1 may have a sensor 201 which may activate the rotation of the pinion 11 upon being triggered by an event (such as flushing, pressure on a toilet seat or the like).

In an embodiment, the flaps 70 of the ring gear 10 may pivot from a First Position A (FIG. 7) to a Second Position B (FIG. 6) and vice versa. More specifically, the flaps 70 may pivot so that the flaps 70 may move upward or downward, toward the center of the opening 25 of the toilet 20. The pivoting of the flaps 70 may allow the toilet 20 to be used without activating the device 1 (in the downward FIG. 7 position) so as to, for example, reduce the chances of any waste 55, paper, or the like from becoming stuck on the flaps 70 or other parts of the device 1. Further, in an embodiment, the directional flow of water may cause the flaps 70 to move from the Second Position (FIG. 6) to the First Position (FIG. 7) if the device 1 is not activated.

Still further, in an embodiment, the flaps 70 may rest in the downward First Position A (FIG. 7) by means of gravity. In particular, the flaps 70 may rest in the downward First Position A by means of, for example, gravity pulling the flaps 70 downward. The flaps 70 may be made of metal, hard plastic, rubber or the like material. When the device 1 is turned on, the centripetal force of the rotating ring gear 10 (and therein flaps 70) may force the flaps 70 upward into a generally parallel orientation with respect to the ring gear 10. Thus, when rotated, the flaps 70 move upward and may better be able to cut the waste 55 located within the interior of the toilet 20.

In an embodiment, the device 1 may have a plurality of suction devices 300 (FIG. 2) which utilizes suction to secure the bottom 3 of the device 1 to the interior of the toilet 20 similar to the use of suction cups in, for example, a car window shade or a non-slip floor matt in the shower. More specifically, in an embodiment, the plurality of suction devices 300 may be placed around the opening 25 of the toilet 20 so as to retrofit a standard toilet 20 with the device 1. In an alternative embodiment, the suction devices 300 may be distributed along the bottom of the system casing and not necessary around the opening of the toilet 20.

Figure 6:
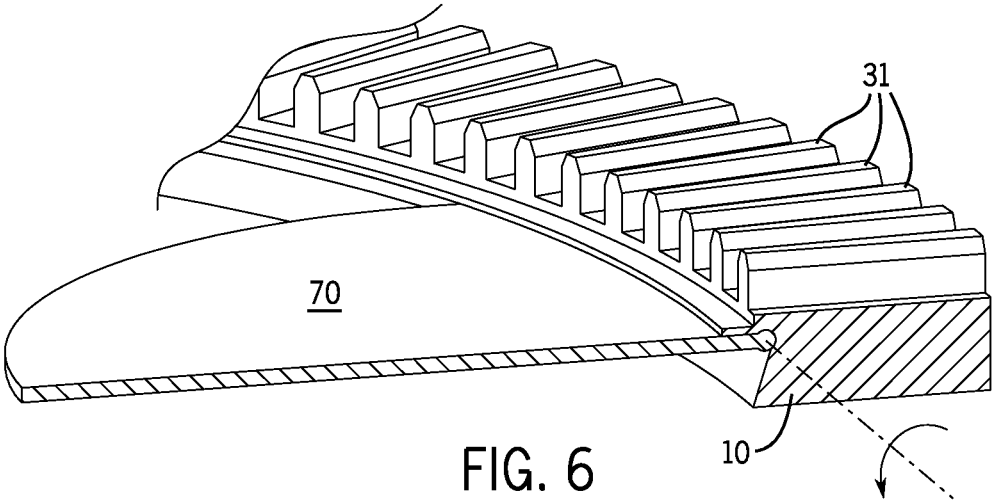
FIG. 6 illustrates a cut away side view of the flaps of the device in the up Second Position.
Figure 7:
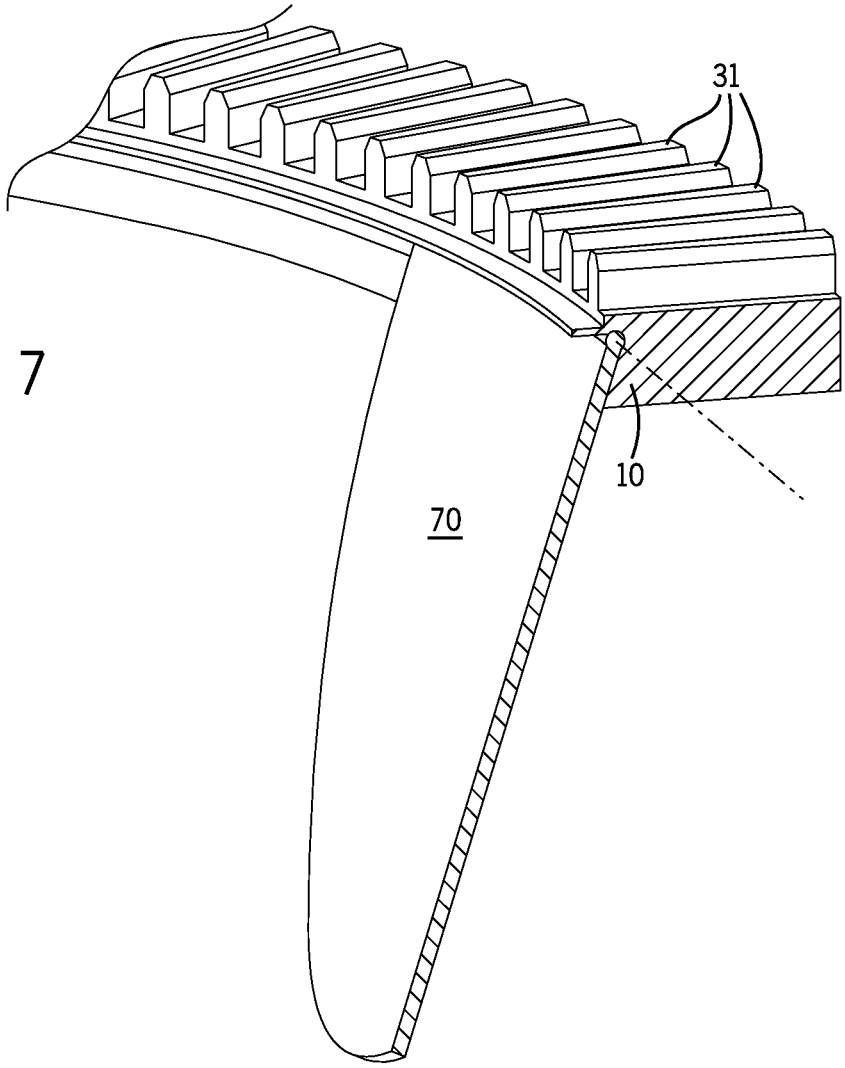
FIG. 7 illustrates a cut away side view of the flaps of the device in the down First Position.
Figure 8:
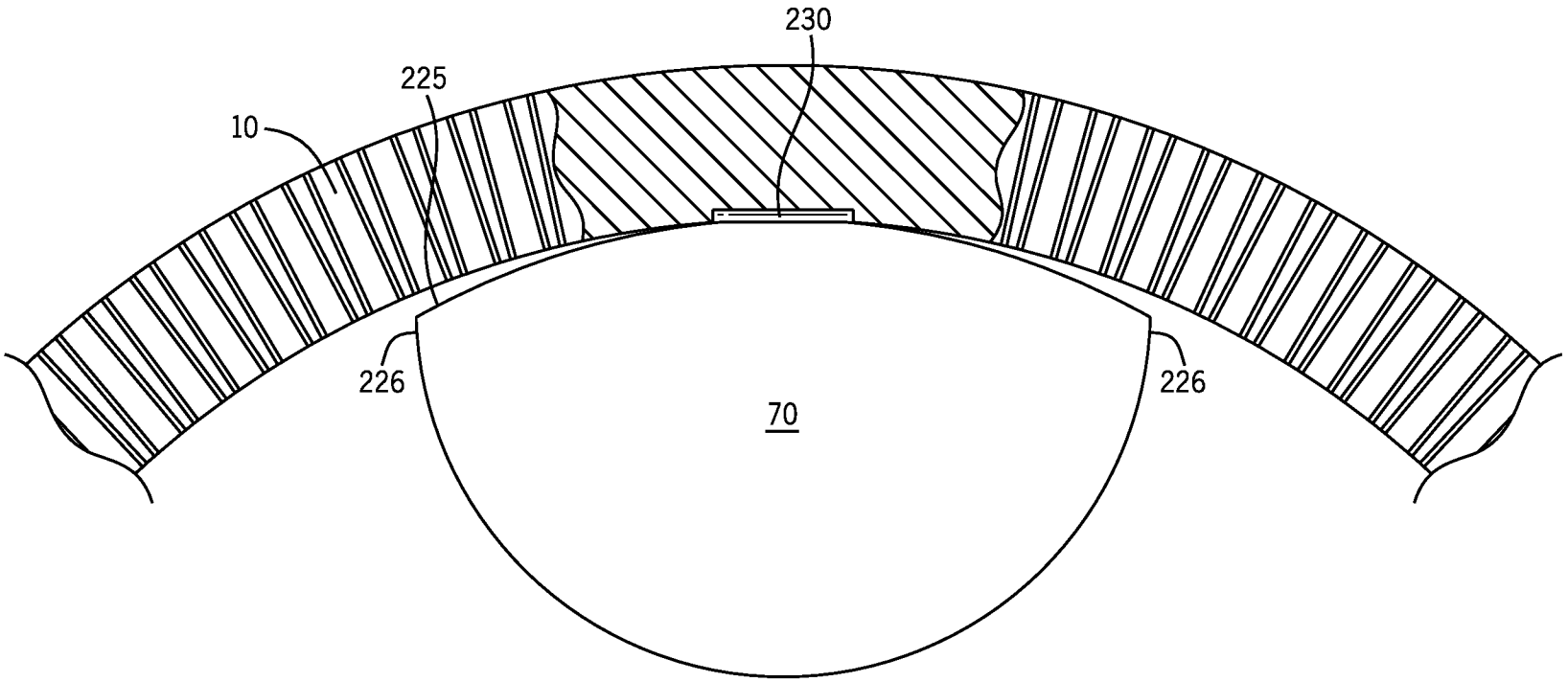
FIG. 8 illustrates an alternative embodiment wherein the flaps of the device are secured to the ring gear at a single connection point.

Referring now to FIG. 8, in an embodiment, the flaps 70 may be secured to the ring gear at a single point of contact. More specifically, a back portion 225 of the flaps 70 (the portion which would normally touch the ring gear 10) may be curved inward at the sides 226 so that the flaps 70 rotate up and down by a pivot pin 230 secured to the ring gear 10. This pivot pin 230 embodiment allows the flaps 70 to more easily rotate from the First Position A to the Second Position B and back as opposed to the embodiment wherein the entire back portion 225 of the flaps 70 is secured to the ring gear 10 (as is shown in FIGS. 6 and 7). In this embodiment, the mobility of the flaps 70 is increased while only slightly allowing waste 55, paper or the like from becoming stuck along the pin 230.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. A waste disposal apparatus for a toilet comprising:

a housing having top, a bottom, a front, a back, a first side, a second side and a generally circular opening wherein the generally circular opening allows the passage of items from the top of the housing out through the bottom of the housing;

a generally circular gear ring located within the housing wherein the generally circular gear ring surrounds the generally circular opening of the housing wherein the generally circular gear ring has an opening having an interior and wherein the generally circular gear ring rotates in a clockwise or counterclockwise manner with respect to the housing and wherein the generally circular gear ring is secured above an outlet opening of a toilet; and a plurality of flaps secured within the interior of the generally circular gear ring wherein the plurality of flaps rotate clockwise or counterclockwise along with the generally circular gear ring and wherein the plurality of flaps contact waste passing through the generally circular opening of the generally circular gear ring and breaks down the waste into smaller units.

2. The waste disposal apparatus of claim 1 further comprising:

a generally circular, cone-shaped funnel surrounding the generally circular gear ring wherein the generally circular, cone-shaped funnel directs waste through the generally circular gear ring of the housing by gravity.

3. The waste disposal apparatus of claim 2 wherein the generally circular, cone-shaped funnel is flexible so as to adopt a similar shape as an interior bowl of the toilet.

4. The waste disposal apparatus of claim 1 further comprising:

a plurality of loops located on an exterior circumference of a generally circular, cone-shaped funnel wherein the plurality of loops allows a user to grasp the apparatus to insert or remove the apparatus from the toilet.

5. The waste disposal apparatus of claim 1 further comprising:

a pinion gear connected to a motor wherein the pinion gear contacts the generally circular ring gear and rotates the generally circular ring gear.

6. The waste disposal apparatus of claim 2 further comprising:

a plurality of suction devices located on the bottom of the generally circular, cone-shaped funnel wherein the plurality of suction devices temporarily secures the apparatus to the interior of a toilet.

7. The waste disposal apparatus of claim 5 further comprising:

a power source connected to the motor.

8. The waste disposal apparatus of claim 1 further comprising:

a top, a bottom, a front, a back, a first side, a second side of the plurality of flaps wherein the back of the plurality of flaps is secured to the generally circular ring gear.

9. The waste disposal apparatus of claim 8 wherein the entire back of each of the plurality of flaps is curved and is secured to the generally circular ring gear in a flush manner.

10. The waste disposal apparatus of claim 8 further comprising:

a pivot pin secured to the back of each of the plurality of flaps wherein the pivot pin is connected to the generally circular ring gear and wherein the pivot pin allows the plurality of flaps to rotate upward and downward.

11. The waste disposal apparatus of claim 1 further comprising:

an LED light indicator connected to the apparatus wherein the LED light indicates if the apparatus is on or off.

12. The waste disposal apparatus of claim 2 wherein the generally circular, cone-shaped funnel remains stationary as the generally circular ring gear and plurality of flaps rotates.

13. A waste disposal apparatus for a toilet comprising:

a housing having top, a bottom, a front, a back, a first side, a second side and a generally circular opening wherein the generally circular opening allows the passage of items from the top of the housing out through the bottom of the housing;

a generally circular gear ring surrounding the opening wherein the generally circular gear ring rotates in a clockwise or counterclockwise manner and wherein the generally circular gear ring is secured above an outlet opening of a toilet;

a plurality of flaps secured within the interior of the generally circular gear ring wherein the plurality of flaps rotate clockwise or counterclockwise along with the generally circular gear ring and wherein the plurality of flaps contact waste passing through the opening and breaks down the waste into smaller units;

a generally circular, cone-shaped funnel surrounding the generally circular gear ring wherein the generally circular, cone-shaped funnel directs waste through the generally circular gear ring of the housing by gravity; and wherein the generally circular, cone-shaped funnel is flexible so as to adopt a similar shape as an interior bowl of the toilet.

14. A waste disposal apparatus for a toilet comprising:

a housing having top, a bottom, a front, a back, a first side, a second side and a generally circular opening wherein the generally circular opening allows the passage of items from the top of the housing out through the bottom of the housing;

a generally circular gear ring surrounding the opening wherein the generally circular gear ring rotates in a clockwise or counterclockwise manner and wherein the generally circular gear ring is secured above an outlet opening of a toilet;

a plurality of flaps secured within the interior of the generally circular gear ring wherein the plurality of flaps rotate clockwise or counterclockwise along with the generally circular gear ring and wherein the plurality of flaps contact waste passing through the opening and breaks down the waste into smaller units;

a generally circular, cone-shaped funnel surrounding the generally circular gear ring wherein the generally circular, cone-shaped funnel directs waste through the generally circular gear ring of the housing by gravity; and a plurality of loops located on an exterior circumference of a generally circular, cone-shaped funnel wherein the plurality of loops allows a user to grasp the apparatus to insert or remove the apparatus from the toilet.

15. A waste disposal apparatus for a toilet comprising:

a housing having top, a bottom, a front, a back, a first side, a second side and a generally circular opening wherein the generally circular opening allows the passage of items from the top of the housing out through the bottom of the housing;

a generally circular gear ring surrounding the opening wherein the generally circular gear ring rotates in a clockwise or counterclockwise manner and wherein the generally circular gear ring is secured above an outlet opening of a toilet;

a plurality of flaps secured within the interior of the generally circular gear ring wherein the plurality of flaps rotate clockwise or counterclockwise along with the generally circular gear ring and wherein the plurality of flaps contact waste passing through the opening and breaks down the waste into smaller units;

a generally circular, cone-shaped funnel surrounding the generally circular gear ring wherein the generally circular, cone-shaped funnel directs waste through the generally circular gear ring of the housing by gravity; and a plurality of suction devices located on the bottom of the generally circular, cone-shaped funnel wherein the plurality of suction devices temporarily secures the apparatus to the interior of a toilet.

16. A waste disposal apparatus for a toilet comprising:

a housing having top, a bottom, a front, a back, a first side, a second side and a generally circular opening wherein the generally circular opening allows the passage of items from the top of the housing out through the bottom of the housing;

a generally circular gear ring surrounding the opening wherein the generally circular gear ring rotates in a clockwise or counterclockwise manner and wherein the generally circular gear ring is secured above an outlet opening of a toilet;

a plurality of flaps secured within the interior of the generally circular gear ring wherein the plurality of flaps rotate clockwise or counterclockwise along with the generally circular gear ring and wherein the plurality of flaps contact waste passing through the opening and breaks down the waste into smaller units; and a top, a bottom, a front, a back, a first side, a second side of the plurality of flaps wherein the back of the plurality of flaps is secured to the generally circular ring gear.

17. The waste disposal apparatus of claim 16 further comprising:

a pivot pin secured to the back of each of the plurality of flaps wherein the pivot pin is connected to the generally circular ring gear and wherein the pivot pin allows the plurality of flaps to rotate upward and downward.

* * * * *